US012747059B2

(12) United States Patent
Lundström et al.

(10) Patent No.: US 12,747,059 B2
(45) Date of Patent: Sep. 29, 2026

(54) PACKAGE FOR HOLDING A FOOD PRODUCT AND MOULD FOR A PACKAGING MACHINE

(71) Applicant: Tetra Laval Holdings & Finance S.A., Pully (CH)

(72) Inventors: Erica Lundström, Malmö (SE); Göran Dahl, Höör (SE); Bengt Håkansson, Sjöbo (SE); Henrik Holm, Veberöd (SE); Pietro Martini, Parma (IT); Per Scharfenort, Furulund (SE); Kristian Jacobsson, Dalby (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 18/578,047

(22) PCT Filed: Jul. 7, 2022

(86) PCT No.: PCT/EP2022/068838
§ 371 (c)(1),
(2) Date: Jan. 10, 2024

(87) PCT Pub. No.: WO2023/285258
PCT Pub. Date: Jan. 19, 2023

(65) Prior Publication Data

US 2024/0375814 A1 Nov. 14, 2024

(30) Foreign Application Priority Data

Jul. 13, 2021 (EP) ..... 21185322

(51) Int. Cl.
*B65D 1/02* (2006.01)
*B65D 8/00* (2006.01)

(52) U.S. Cl.
CPC ..... *B65D 1/0215* (2013.01); *B65D 11/04* (2013.01); *B65D 2501/009* (2013.01)

(58) Field of Classification Search
CPC .... A47G 21/186; B65D 5/4266; B65D 5/746; B65D 1/0215; B65D 11/04; B65D 2501/009; B65D 3/08; B65D 15/02
See application file for complete search history.

(56) References Cited

U.S. PATENT DOCUMENTS 1,100,448 A * 6/1914 Selz ..... B65D 5/24 229/125.17
1,754,496 A 4/1930 Barker
(Continued)

FOREIGN PATENT DOCUMENTS

CA 957301 A 11/1974
CN 111867942 A 10/2020
(Continued)

OTHER PUBLICATIONS

International Search Report mailed Sep. 5, 2022, for International Patent Application No. PCT/EP2022/068838.

*Primary Examiner* — Kareen K Thomas
(74) *Attorney, Agent, or Firm* — Renner, Otto, Boisselle & Sklar, LLP

(57) ABSTRACT

A package for holding a food product. The package comprises a base, a sidewall, a shoulder, a neck and a closure for forming a sealed, inner space for the food product. The base and the sidewall being formed from a multilayer packaging material that comprises a layer of fibrous material. The shoulder comprises a plurality of flap sections that are formed from a multilayer packaging material, extend from the sidewall and are folded towards each other in a direction towards the neck, with each flap section having lateral edges facing lateral edges of neighboring flap sections, and a
(Continued)

plurality of molded seams join the lateral edges of neighboring flap sections.

13 Claims, 10 Drawing Sheets

(56) References Cited

U.S. PATENT DOCUMENTS

| | | | | | |
|---|---|---|---|---|---|
| 2,132,672 | A * | 10/1938 | Berry | B65D 3/02 | 229/4.5 |
| 3,119,540 | A | 1/1964 | Schenk et al. | | |
| 4,618,444 | A * | 10/1986 | Hudson | C11D 3/3932 | 510/309 |
| 5,088,642 | A * | 2/1992 | Farber | B65D 5/746 | 229/125.13 |
| 5,323,956 | A | 6/1994 | Marcontell | | |
| 5,804,016 | A * | 9/1998 | Schmidt | B65D 1/0215 | 264/513 |
| 6,016,953 | A * | 1/2000 | Stacy-Ryan | B65D 5/06 | 229/113 |
| 7,597,244 | B2 * | 10/2009 | Boldrini | B65D 15/22 | 229/125.17 |
| 9,284,091 | B2 * | 3/2016 | Shalkop | B65D 5/746 | |
| 2001/0008252 | A1 * | 7/2001 | Ammons | B31B 50/84 | 229/184 |
| 2003/0155321 | A1 * | 8/2003 | Bauer | B65D 51/20 | 215/253 |
| 2004/0262322 | A1 * | 12/2004 | Middleton | B65D 43/169 | 220/675 |
| 2007/0262487 | A1 | 11/2007 | O'Hagan et al. | | |
| 2018/0155081 | A1 * | 6/2018 | Nyuu | A23L 27/60 | |
| 2019/0112091 | A1 * | 4/2019 | Neufarth | B29C 49/06 | |
| 2019/0193905 | A1 * | 6/2019 | Reynoso | B65D 75/20 | |
| 2020/0324456 | A1 * | 10/2020 | Mamak | B65D 1/0215 | |

FOREIGN PATENT DOCUMENTS

| | | | |
|---|---|---|---|
| DE | 102005048821 | A1 | 4/2007 |
| JP | 61178329 | U | 11/1986 |
| JP | 2014094776 | A | 5/2014 |
| WO | 2008086808 | A1 | 7/2008 |
| WO | 2010085182 | A1 | 7/2010 |

* cited by examiner

PACKAGE FOR HOLDING A FOOD PRODUCT AND MOULD FOR A PACKAGING MACHINE

TECHNICAL FIELD

The present invention relates to a package for holding a food product, in particular a pourable food product.

The present invention also relates to a mold for a packaging machine.

The present invention also relates to a method for packaging a food product, in particular a pourable food product, into a package.

BACKGROUND

As is known, many food products, in particular pourable food products, such as fruit juice, milk, UHT (ultra-high-temperature treated) milk, wine, tomato sauce, yoghurt, cottage cheese, soup, salt, sugar etc., are sold in packages at least partially being made from a multilayer packaging material.

One of the prominent examples of such packages is the bottle-shaped package for pourable food products known as Tetra Top (registered trademark). Such packages are formed from a laminated multilayer packaging material and a top portion molded to the multilayer packaging material.

The multilayer packaging material comprises a carton and/or paper base layer, covered on both sides with layers of heat-seal plastic material, e.g. polyethylene. In the case of aseptic packages for long-storage products, the multilayer packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

While the multilayer packaging material is formed into a main body having an inner space, the top portion comprises a shoulder mounted to the main body, a neck extending from the shoulder and having a pouring outlet and a closure removably attached to the neck for selectively closing and opening the pouring outlet.

Even though the known packages for food products work satisfyingly well, a need is felt in the sector to even further improve the known packages. In particular, a need is felt in order to reduce the amount of plastic, thereby maintaining an appealing aesthetical appearance.

SUMMARY

It is an object of the invention to at least partly overcome one or more limitations of the prior art. In particular, it is an object to provide a package coming along with a reduced quantity of plastic and to maintain an appealing aesthetical appearance.

It is a further object of the present invention to provide a mold for a packaging machine.

It is another object of the present invention to provide a method for packaging a food product in a package.

According to the present invention, there is provided a package.

According to the present invention, there is also provided a mold.

According to the present invention, there is also provided a method for packaging a food product into a package.

In addition, according to one aspect of the invention, there is provided a package for holding a food product. The package comprises a base, a sidewall, a shoulder, a neck and a closure for forming a sealed, inner space for the food product. The base and the sidewall are formed from a multilayer packaging material that comprises a layer of fibrous material. The shoulder comprises a plurality of flap sections that are formed from a multilayer packaging material, the flap sections extend from the sidewall and are folded towards each other in a direction towards the neck, with each flap section having lateral edges facing lateral edges of neighboring flap sections. The shoulder also comprises a plurality of molded seams that join the lateral edges of neighboring flap sections.

By having such a package, it is possible to maintain an appealing bottle-shape of the package thereby reducing the quantity of plastics used.

The neck may be a molded neck that is joined with the molded seams, the molded seams may extend from the molded neck along the lateral edges of the flap sections and in a direction towards the sidewall.

In this way, one obtains a compact package with reduced risks of the formation of perforations, which may allow leakages and/or contaminations of the food product. Furthermore, the neck and the molded seams are resistant.

Each flap section may comprise a top edge and the neck may be molded to the top edges of the flap sections.

In this way one obtains a good connection between the neck and the flap sections guaranteeing the sealing of the inner surface.

The molded seams may be integrally molded with the molded neck. Thereby, the sealing effect is guaranteed and providing a connection having a high resistance between the neck and the seams.

The flap sections may be integrally formed with the sidewall. In this way, one avoids any possible risks of the formation of perforations or similar.

The molded seams may be overmolded on the lateral edges of the flap sections. This guarantees a very good and resistive connection between the seams and the flap sections.

The combined thickness of each molded seam and the respective flap sections that are joined by the molded seam is at least 20% greater than a thickness of the molded seam at a location between the lateral edges of the flap sections that are joined by the molded seam.

This guarantees a correct flow characteristics of the molten polymer during the formation of the molded seams.

Each lateral edge may comprise a curved shape. In this way one can easily form and define the desired shape of the shoulder.

Each lateral edge may comprise a first curved portion and a second curved portion. The first curved portion may be different from the second curved portion.

Alternatively or in addition, the first curved portion may be convexly shaped and the second curved portion may be concavely shaped with respect to a central axis of the respective flap section.

These two alternative or combined solutions facilitate the correct formation of the desired shoulder.

Each flap section may comprise a base portion integrally joined with the sidewall, and a top portion having a top edge opposite to the base portion, and the lateral edges of each flap section may be spaced apart from one another and may be joined with the base portion and the top portion of the respective flap section.

The width of the base portion may be larger than the width of the top portion. In this manner one obtains a shoulder which tampers towards the neck.

The flap sections may comprise a first group of flap sections and a second group of flap sections. The flap sections of the first group may have different shapes and dimensions with respect to the flap sections of the second group. This allows to define a particular shape of the shoulder.

In addition, according to one aspect of the invention, there is provided a mold for molding a neck and molded seams of the package. The mold has an inner mold tool and an outer mold tool, defining in collaboration a mold cavity configured to allow for the formation of the neck. The inner mold tool comprises engagement sections configured to receive and fold flap sections in collaboration with the outer mold tool towards each other such that lateral edges of the flap sections face lateral edges of neighboring flap sections and mold channels located between the engagement sections and configured to allow for the formation of the molded seams.

By having such a mold it is possible to form the shoulder and the neck of the package in an efficient and easy manner. The mold guarantees that the flap sections are aligned correctly such that the seams join neighboring lateral edges.

In addition, according to one aspect of the invention, there is provided a method for packaging a food product into a package. The method comprises the steps of:

- providing a blank of a multilayer packaging material having a main portion and a plurality of flap sections that extend from the main portion,
- folding and longitudinally sealing the blank so as to form the sidewall,
- folding the flap sections towards each other so that lateral edges of neighboring flap sections face each other,
- injection molding the neck and the molded seam portions to join the lateral edges of neighboring flap sections so as to form the shoulder,
- providing a closure on the neck,
- filling a food product into the package at a bottom end of the package, and
- sealing the bottom end to form the base.

The method may also comprise the step of providing and/or applying a closure on the neck.

Still other objectives, features, aspects and advantages of the invention will appear from the following detailed description as well as from the drawings.

DRAWINGS

Embodiments of the invention will now be described, by way of example, with reference to the accompanying schematic drawings.

FIG. 1 is a perspective view of a package having a main body and a top portion molded to the main body;

FIG. 2*a* is a top view of the package of FIG. 1;

FIG. 2*b* is a perspective enlarged side view of a portion of the main body and of a portion of the top portion of the package of FIG. 1;

FIG. 3*a* is a top view of a multilayer packaging material that forms the main body of the package of FIG. 1;

FIG. 3*b* is an enlarged view of flap sections of the multilayer packaging material of FIG. 3*a;*

Figure 5:
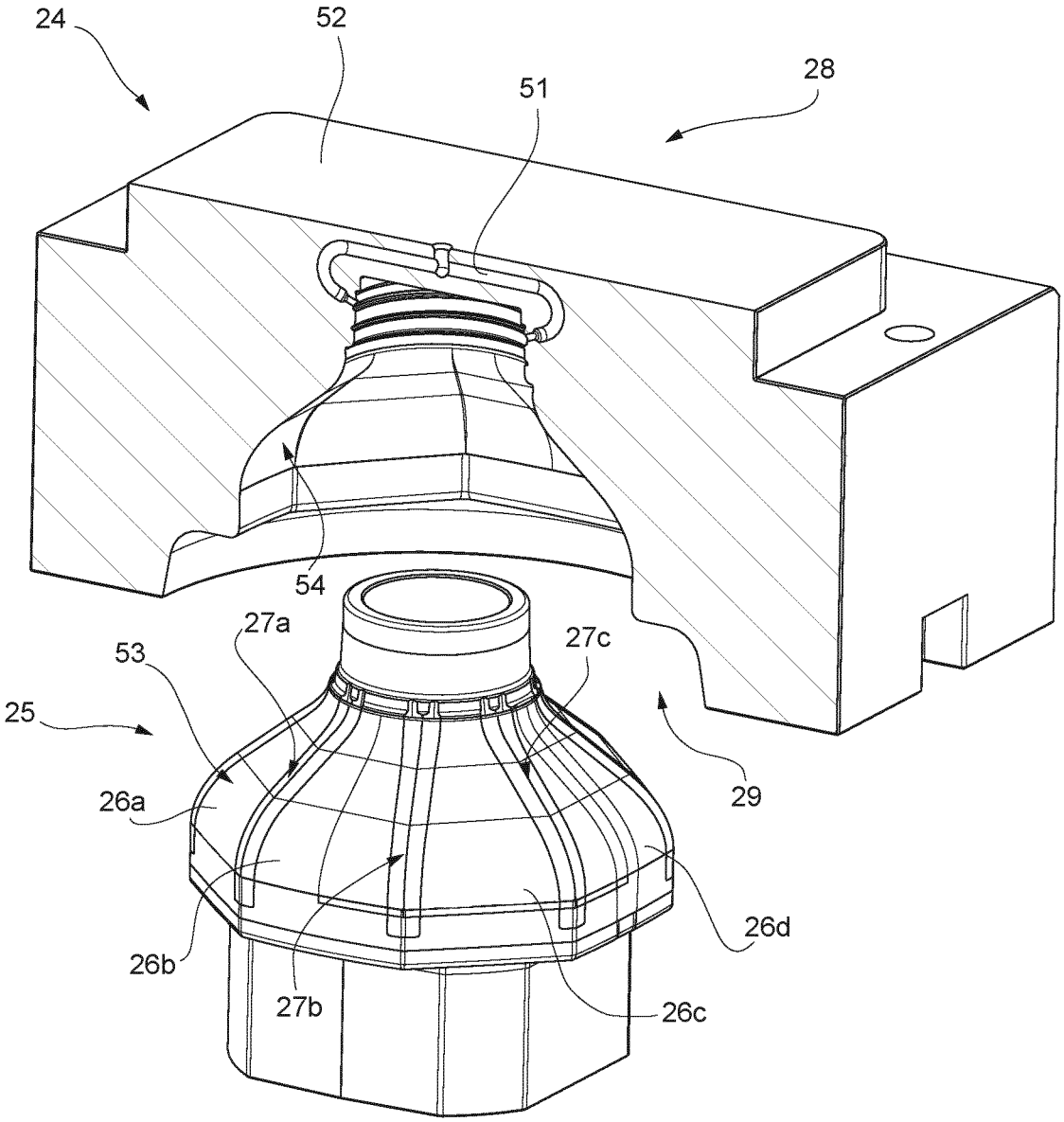
FIG. 5 is a perspective view of a mold for molding the top portion of the package of FIG. 1 to the main body of the package of FIG. 1.
Figure 6A:
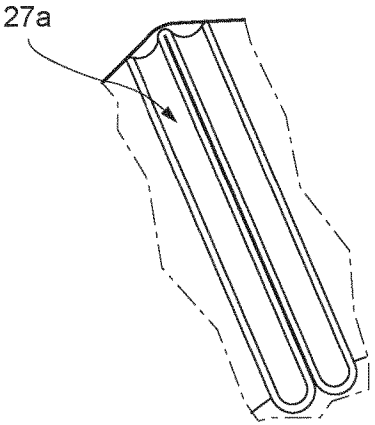
Figure 6B:
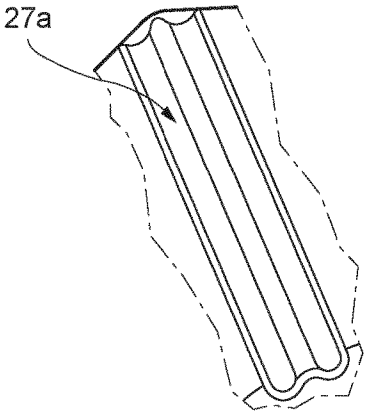
Figure 6C:
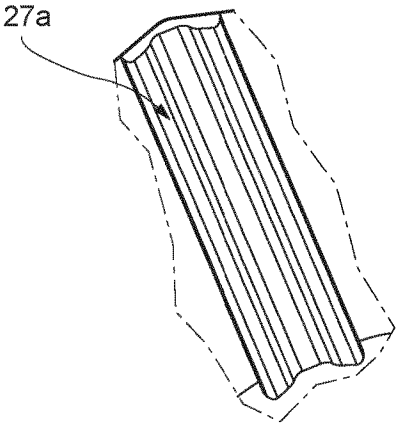
Figure 6D:
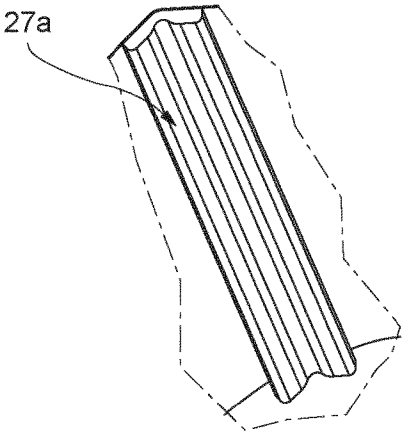
Figure 6E:
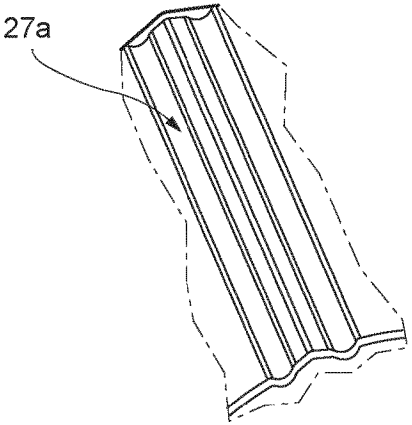
Figure 6F:
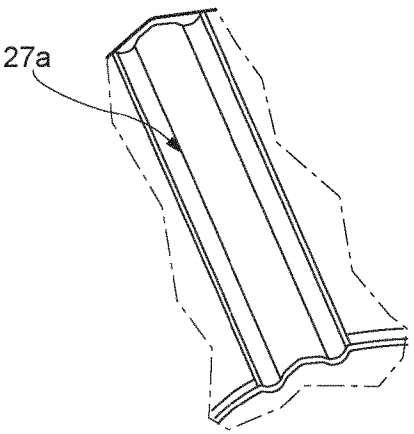
Figure 7:
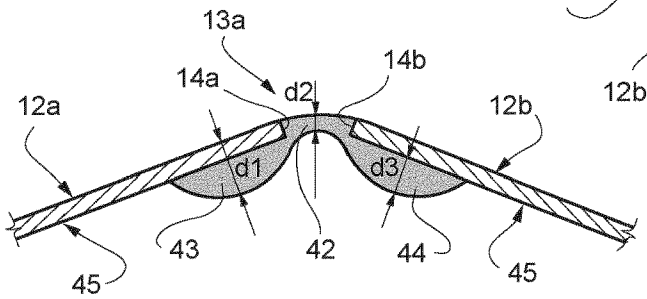
Figure 9:
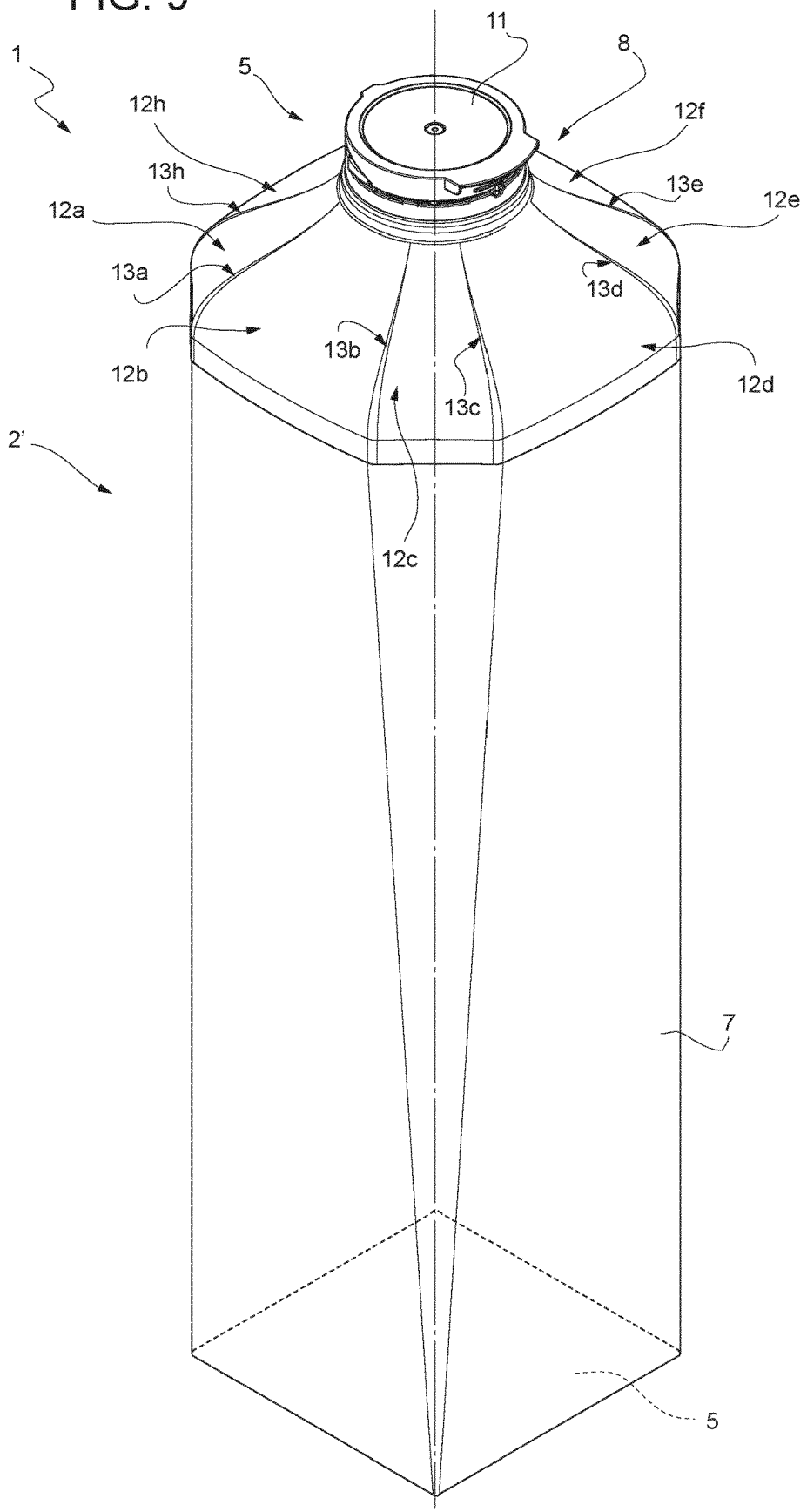
Figure 10:
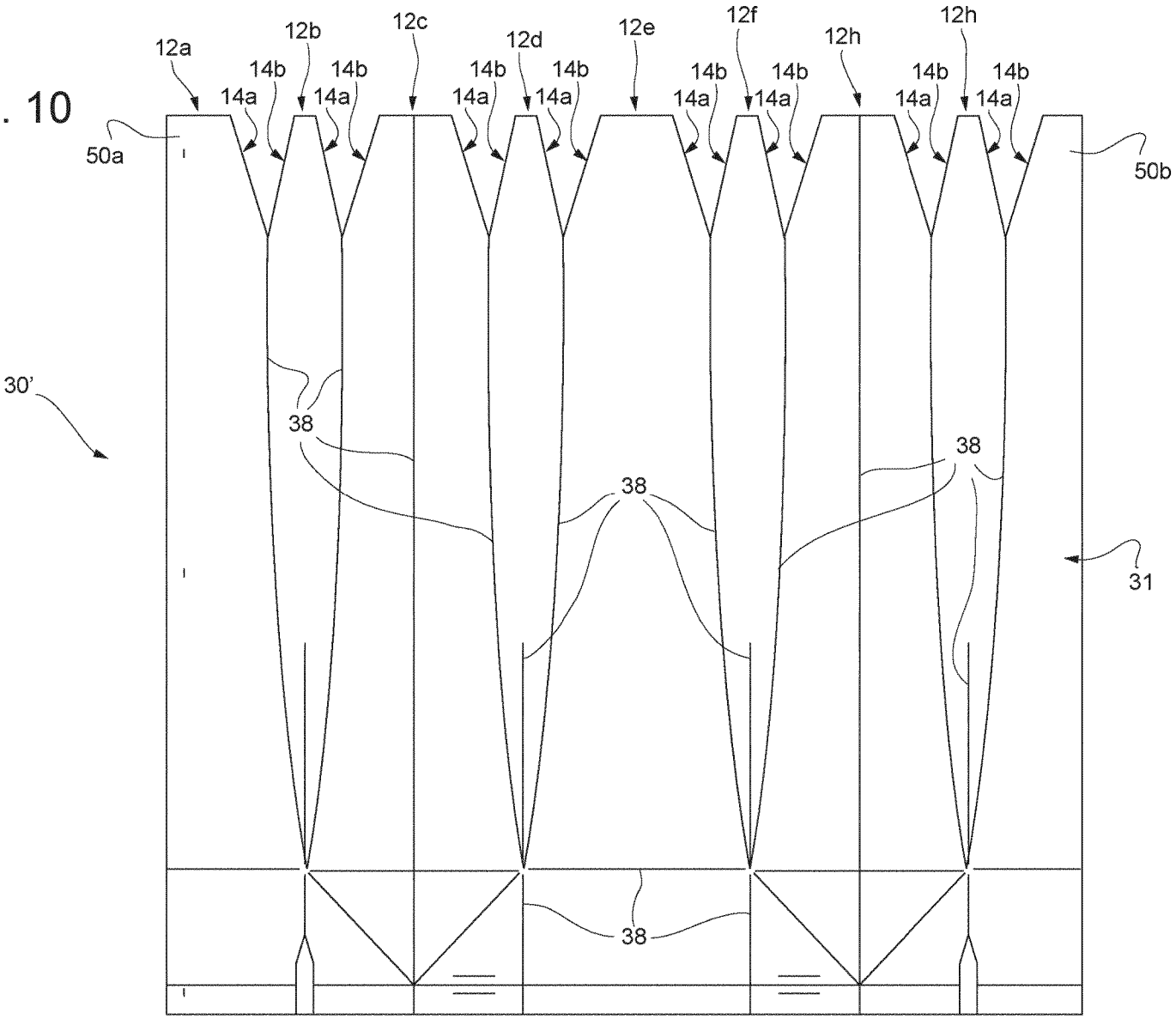
Figure 11:
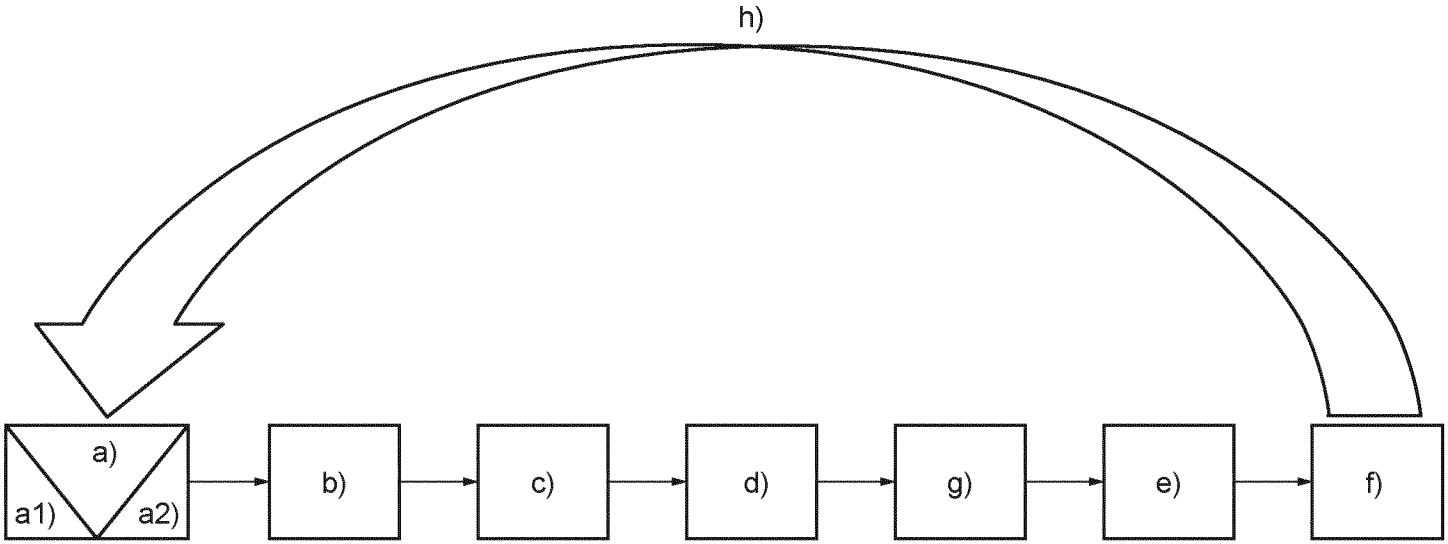

FIGS. 6*a* to 6*f* are variations of mold channels of the mold of FIG. 5;

FIG. 7 is a cross-sectional view of a seam section of the package joining two neighboring flap sections to one another;

FIGS. 8*a* to 8*d* are top views of variations of the package;

FIG. 9 is a perspective view of a variation of the package;

FIG. 10 is a top view of a multilayer packaging material for forming the package of FIG. 9; and FIG. 11 is a flow chart of a method for packaging a food product into a package.

DETAILED DESCRIPTION

Embodiments of the invention will now be described more fully hereinafter with reference to the accompanying drawings, in which some, but not all, embodiments of the invention are shown. The invention may be embodied in many different forms and should not be construed as limited to the embodiments set forth herein.

Figure 1:
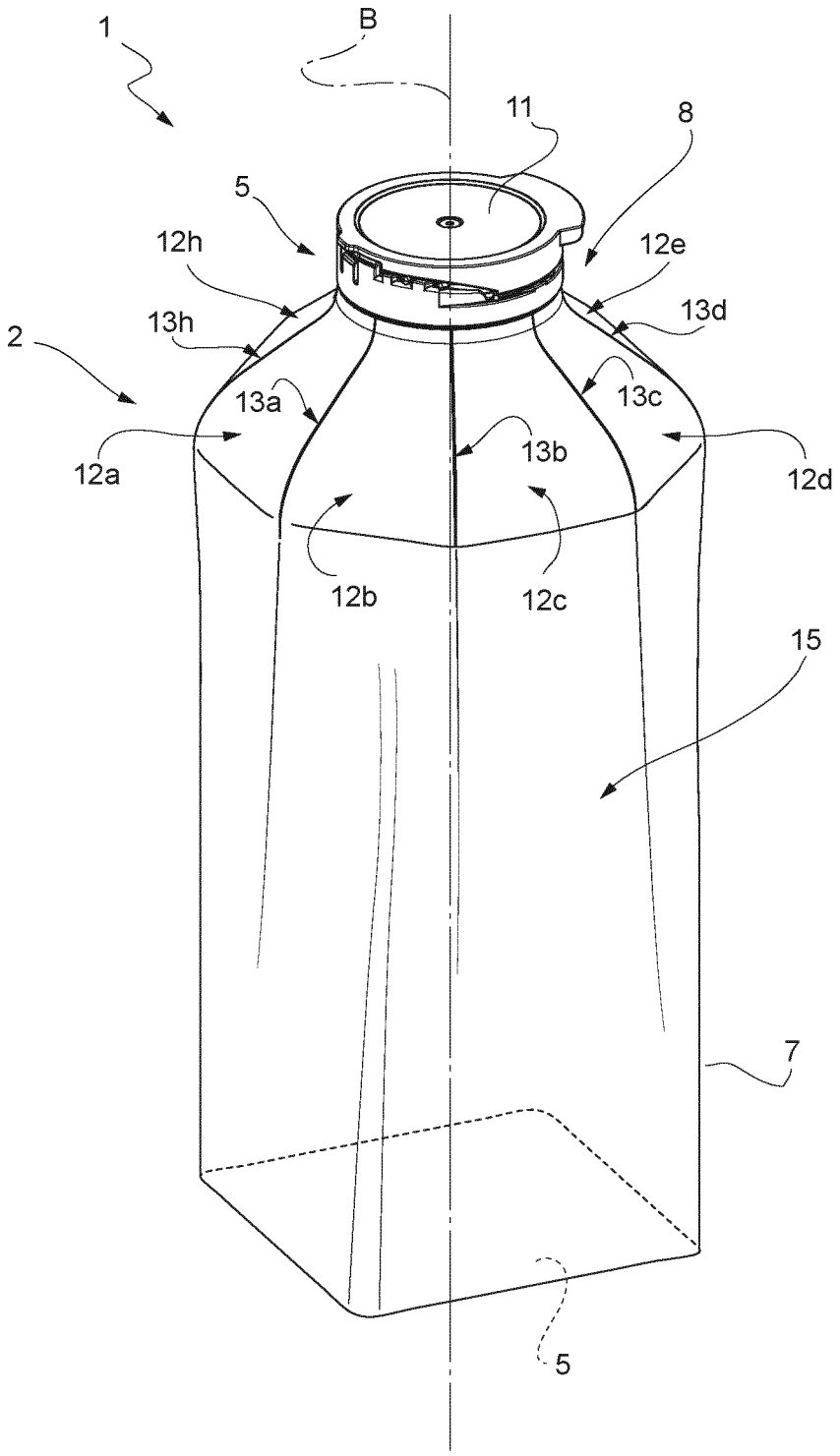
Figure 2A:
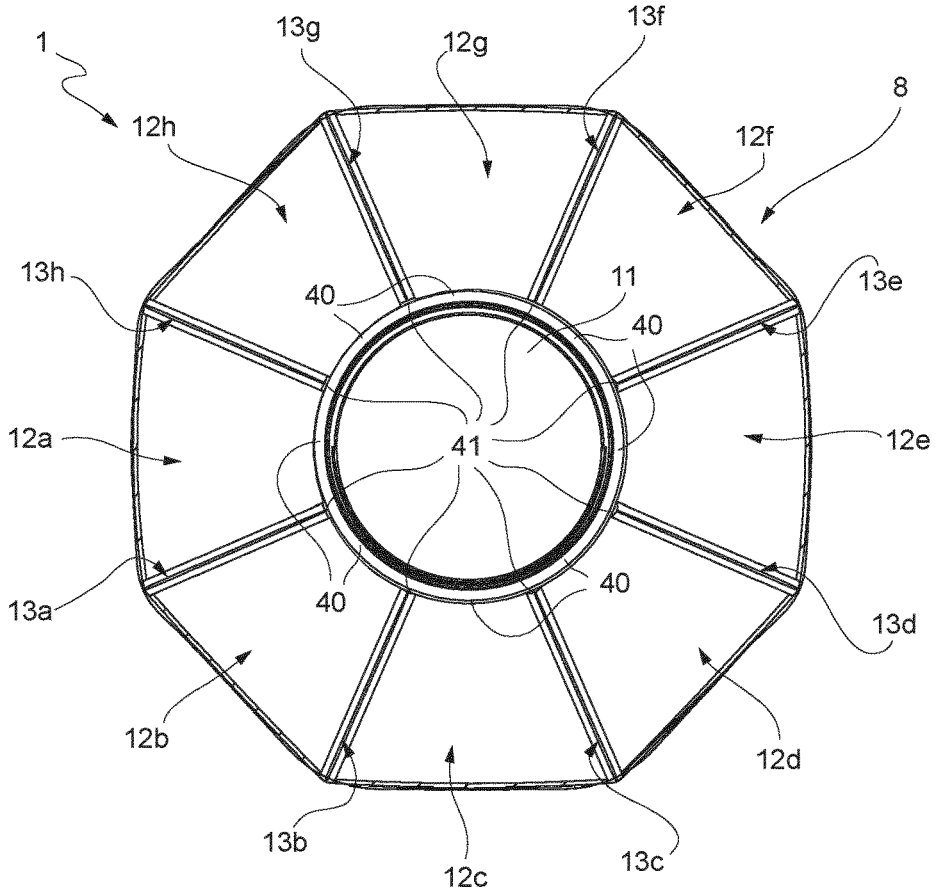
Figure 2B:
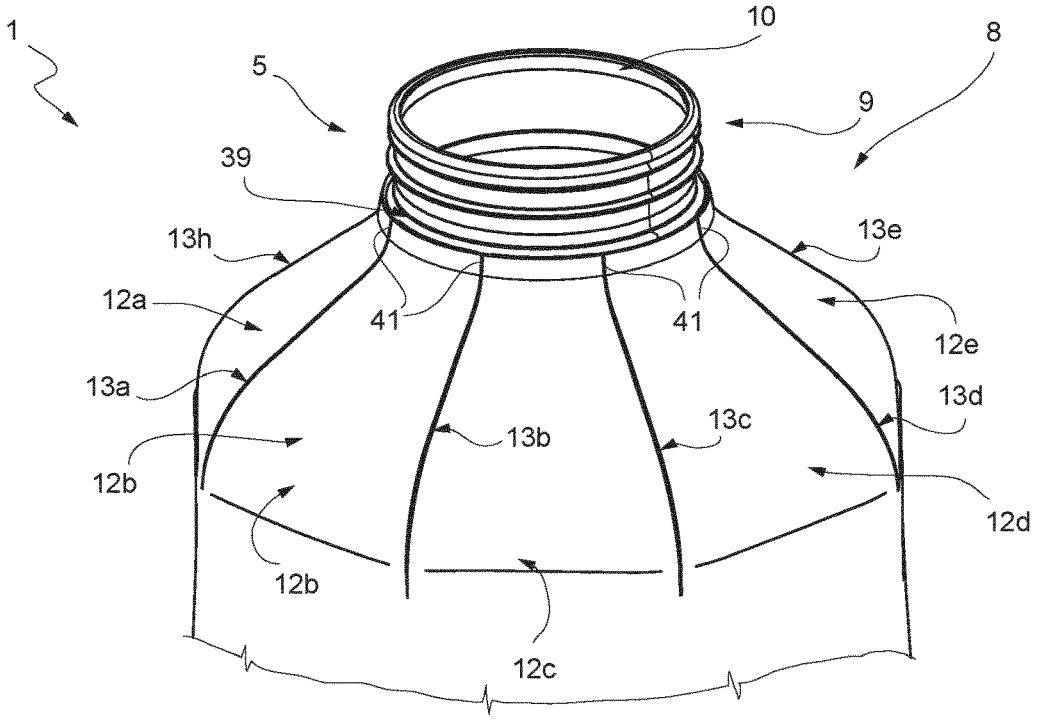

With reference to FIGS. 1, 2*a* and 2*b* an exemplary package 1 for holding a food product, in particular a pourable food product, such as milk, yoghurt, tomato sauce, soup, salt, sugar or similar, is illustrated.

In more detail, package 1 comprises a main body 2 formed from a multilayer packaging material 3 and a top portion 5 molded to the main body 2. In particular, package 1 may be bottle-shaped.

The multilayer packaging material 3 may comprise: a layer of fibrous material 4, such as e.g. paper or cardboard, and at least two layers of heat-seal plastic material 35, e.g. polyethylene, interposing the layer of fibrous material 4 in between one another.

Moreover, the multilayer packaging material 3 may also comprise a layer of gas- and light-barrier material 36, e.g. aluminum foil or ethylene vinyl alcohol (EVOH) film, in particular being arranged between one of the layers of heat-seal plastic material 35 and layer of fibrous material 4. Preferentially, the multilayer packaging material 3 may also comprise a further layer of heat-seal plastic material 37 being interposed between the layer of gas- and light-barrier material 36 and the layer of fibrous material 4.

Turning back to FIGS. 1, 2*a* and 2*b*, the main body 2 comprises: a bottom 6, a side wall 7 extending from the bottom 6, in particular along a central (longitudinal) axis B, and a plurality of flap sections 12*a* to 12*h* extending from the sidewall 7, being folded towards each other in a direction towards a neck 9 of the top portion 5 and each flap section 12*a* to 12*h* having respective lateral edges 14*a* and 14*b*. Each lateral edge 14*a* faces a respective lateral edge 14*b* and each lateral edge 14*b* faces a respective lateral edge 14*a* of the respective neighboring flap sections 12*a* to 12*h*.

Flap sections 12*a* to 12*h* may be equally spaced around the central axis B.

Top portion 5 comprises besides the neck 9, a plurality of molded seams 13*a* to 13*h*, each molded seam 13*a* to 13*h* joins one lateral edge 14*a* of one of respective flap section 12*a* to 12*h* of the flap sections 12*a* to 12*h* with the lateral edge 14*b* of a respective neighboring flap section 12*a* to 12*h*. E.g. the molded seam 13*a* joins the lateral edge 14*a* of the flap section 12*a* with the lateral edge 14*b* of the flap section 12*b*.

According to the example shown, each lateral edge 14*a* and the respective lateral edge 14*b* may remain distanced from one another (i.e. they do not contact) also after having been joined by the respective seam 13*a* to 13*h*. Alternatively, one or more or even all of the lateral edges 14*a* may be in contact with respective lateral edge 14*b* after having been joined by the respective seam 13*a* to 13*h*.

The flap sections 12*a* to 12*h* and the seams 13*a* to 13*h* form a shoulder 8 of package 1.

Neck 9 may be a molded neck that may be joined with the molded seams 13*a* to 13*h*. Each one of the molded seams 13*a* to 13*h* may extend from the molded neck 9 and along the respective lateral edges 14*a* and 14*b* of the two respective flap sections 12*a* to 12*h* and in a direction towards the sidewall 7. Each one of the molded seams 13*a* to 13*h* may be connected, in particular molded, to the sidewall 7.

The base 6 may be opposed to top portion 5.

The top portion 5 may be vertically arranged above the base 6.

The top portion 5 may be spaced apart from the base 6 along the central axis B.

The neck 9 may comprise a pouring outlet 10 allowing for the outpouring of the pourable product.

The neck 9 may also comprise a sealing membrane removably attached to the neck 9 for sealing the pouring outlet 10 at least prior to the first time outpouring of the pourable product.

Alternatively or in addition, the package 1, in particular the top portion 5, may comprise a closure 11, that may be removably attached to the neck 9 so as to allow to at least selectively open, preferentially to selectively open and close, a pouring outlet 10 of the neck 9.

More specifically, the base 6 may define a support surface of package 1, in particular of the main body 2, which may be configured to be put in contact with a support surface, such as a shelf, e.g. when, in use, being exposed within a sales point or similar or when being stored in a transport box, a fridge, a storage shelf or similar. In particular, it is readily recognizable that the base 6 is to be arranged at a lower position than the other portions of the package 1, when being placed on the support surface. In particular, the base 6 defines the lowest portion of package 1.

Furthermore, also during a manipulation of the closure 11 for opening the pouring outlet 10, the base 6 may define the lowest position of the main body 2.

Thus, in the following any references referring to top, bottom, upper, lower, above, beneath and similar refers to package 1 being placed e.g. on a support surface or when being held by a consumer when this latter intends to manipulate the closure 11 and/or the sealing membrane, having the base 6 at the lowermost position the pouring outlet 10 is located vertically above the base 6.

In other words, a "correct" orientation of the package 1 is such that the base 6, when being viewed by the consumer, is arranged at a lower position than the top portion 5 as otherwise the manipulation of the closure 10 and/or of the sealing membrane would lead to a non-desired spilling of the food product.

The neck 9 may comprise an annular cross-section with respect to a cross-section plane being perpendicular to the central axis B.

Figure 3A:
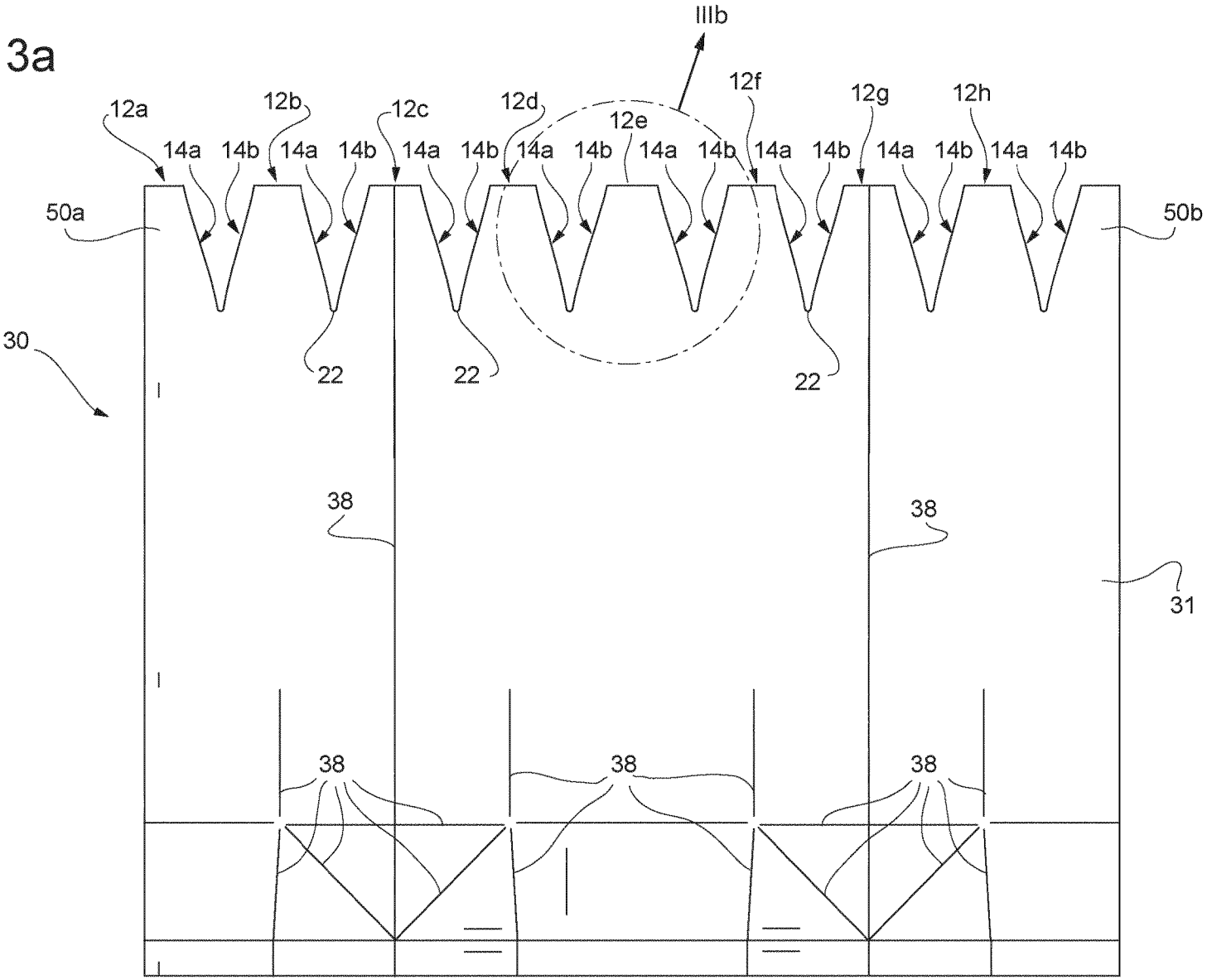

FIG. 3*a* illustrates a blank 30, which in use, is folded and sealed so as to allow for the formation of the main body 2. The blank 30 may comprise a main portion 31, which after being folded and sealed defines the base 6 and the sidewall 7. The flap sections 12*a* to 12*h* may extend from the main portion 31, in particular a zone of the main portion 31 which defines the sidewall 7 once main body 2 has been formed. The flap sections 12*a* to 12*h* may be integrally formed with the main portion 31, in particular the zone defining the sidewalls 7.

Thus, the flap sections 12*a* to 12*h* may be integrally formed with the sidewall 7.

Furthermore, the blank 30, in particular the main portion 31, may comprise a plurality of crease lines 38. The crease lines 38 may partially define the shape of the main body 2.

Each blank 30 may be obtained from cutting a web of the multilayer packaging material. The web may comprise a plurality of successively arranged and continuously connected repeat units. The web may be cut in correspondence of the repeat units so as to form the blanks 30.

Alternatively, the blank 30 may be provided as a single blank 30.

With reference to FIGS. 1 to 2*b* and 3*a* and 3*b*, each flap section 12*a* to 12*h* may comprise a respective top portion 17 and a base portion 20 integrally joined with the sidewall 7 (or to the main portion 31 when considering the unfolded blank 30). In particular, the base portions 20 may be connected to the sidewall 7 or to the main portion 31 along a fold line so as to allow for the folding of the flap sections 12*a* to 12*h* towards the neck 9.

Each top portion 17 may have a respective top edge 21. The top edge 21 may be a free top edge 21 when considering the unfolded blank 30.

Each flap section 12*a* to 12*h* may comprise a respective central axis A, in particular the central axis A may define a symmetry axis. The central axis A may be interposed between the respective lateral edge 14*a* and the respective lateral edge 14*b*.

Each top portion 17 and the respective base portion 20 may be spaced apart from one another along the respective central axis A.

Each top edge 21 and the base portion 20 and/or the respective fold line define the height h of the respective flap section 12*a* to 12*h*.

Reverting to FIGS. 1, 2*a* and 2*b*, the neck 9 may be molded to the flap sections 12*a* to 12*h*. More specifically, the neck 9 may be molded to the top edges 21.

The neck 9 may comprise a (bottom) coupling portion 39 molded to the flap sections 12*a* to 12*h*. The coupling portion 39 may comprise a plurality of sections 40 angularly spaced apart from one another about the central axis A and each section 40 extending between two respective connection points 41. From each one of the connection points 41 extends one respective seam 13*a* to 13*h* towards the sidewall 7. In particular, each seam 13*a* to 13*h* is integrally connected to the neck 9 at a respective connection point 41.

The neck 9 may be molded to each of the top edges 20. In particular, each section 40 may be molded to one respective top edge 20.

With reference to FIG. 7, each seam 13*a* to 13*h* may comprise a central portion 42, a first lateral portion 43 and a second lateral portion 44 integrally formed with one another. Each central portion 42 may be interposed between the respective first lateral portion 43 and the respective second lateral portion 44.

Moreover, each central portion 42 may be interposed between and connected to the respective lateral edge 14*a* and the respective lateral edge 14*b*. Additionally, each one of the respective first lateral portion 43 and the respective second lateral portion 44 may contact a relative inner surface 45 of the respective flap sections 12*a* to 12*h*. In particular, each inner surface 45 may face the inner space 15.

More specifically, each seam 13*a* to 13*h* may be overmolded, in particular during a single molding step, on the respective lateral edge 14*a* and the respective lateral edge 14*b*. The respective first lateral portion 43 and the respective second lateral portion 44 may be overmolded on the respective inner surface 45 of the respective flap sections 12*a* to 12*h*.

Overmolding may mean in the present context, that a molten polymer is brought, in particular during the single molding step, in contact with the respective flap sections 12*a* to 12*h* leading to a fusion of the respective layer of heat-seal plastic material 35 with the molten polymer, which further on solidifies. In particular, during the respective overmolding, the layer of the heat-seal plastic material 35 may be fused together with the respective first lateral portion 43 and the respective second lateral portion 44.

Referring again to FIG. 7, a combined (maximum) thickness d1 of each molded seam 13*a* to 13*h* and the respective flap sections 12*a* to 12*h* that are joined by the molded seam 13*a* to 13*h* is at least 20% greater than a (minimum) thickness d2 of the molded seam 13*a* to 13*h* at a location between the respective lateral edges 14*a* and 14*b* of the respective flap sections 12*a* to 12*h* that are joined by the molded seam 13*a* to 13*h*.

In more detail, the combined thickness d1 may be determined as the maximum thickness as defined by either the respective first lateral portion 43 and the portion of the respective flap section 12*a* to 12*h* to which the respective first lateral portion 43 is connected to or by the respective second lateral portion 44 and the portion of the respective flap section 12*a* to 12*h* to which the respective second lateral portion 44 is connected to. The minimum thickness d2 may be determined as the minimum thickness of the respective central portion 42.

Furthermore, a respective (maximum) thickness d3 of each first lateral portion 43 and of each second lateral portion 44 is larger than the respective thickness d2.

Preferentially, each combined thickness d1 and/or each thickness d2 and/or each thickness d3 may be determined with respect to an axis normal to the respective flap section 12*a* to 12*h* and in proximity to the respective lateral edge 14*a* or the respective lateral edge 14*b*.

Turning back to FIGS. 3*a* and 3*b*, each lateral edge 14*a* and each lateral edge 14*b* may comprise and/or present a curved shape.

Each lateral edge 14*a* and each lateral edge 14*b* of each flap section 12*a* to 12*h* may comprise a respective first curved portion 18 and a respective second curved portion 19. Thereby, each first curved portion 18 may be different from the respective second curved portion 19. More specifically, each first curved portion 18 may be described by a respective first radius r1 and each second curved portion 19 may be described by a respective second radius r2 distinct from the respective first radius r1.

Alternatively or in addition, each first curved portion 18 may be convexly shaped and the respective second curved portion 19 may be concavely shaped with respect to the respective central axis A.

It should be noted that each lateral edge 14*a* and each lateral edge 14*b* may also comprise one or more further curved portions. Thereby, the curved portions may be different in shape from the respective first curved portion 18 and/or the respective second curved portion 19.

Furthermore, a respective width w1 of each base portion 20 may be larger than the respective width w2 of the respective top portion 17. Each width w1 may be measured along the respective interface of the respective flap section 12*a* to 12*h* with the sidewall 7 or the main portion 31 and each width w2 may be measured along the respective top edge 21.

The ratio w1/w2 between width w1 and width w2 may lie between 3.0 to 1.5 or between 2.5 to 2.0.

One or more, in the specific example shown all, of the flap sections 12*a* to 12*h* may have a respective height h that is at least 5% to 30% or 5% to 20% larger than the respective widths w1.

Each lateral edge 14*a* and each lateral edge 14*b* may be joined with the respective base portion 20 at a first location 46 and with the respective top portion 17 at a second location 47. Each first location 46 and the respective second location 47 are arranged such that a respective imaginary line L through the first location 46 and the respective second location 47 define an angle $\alpha$ with the respective central axis A which is larger than 0° and smaller than 70°, in particular larger than 10° and smaller than 60°.

Figure 3B:
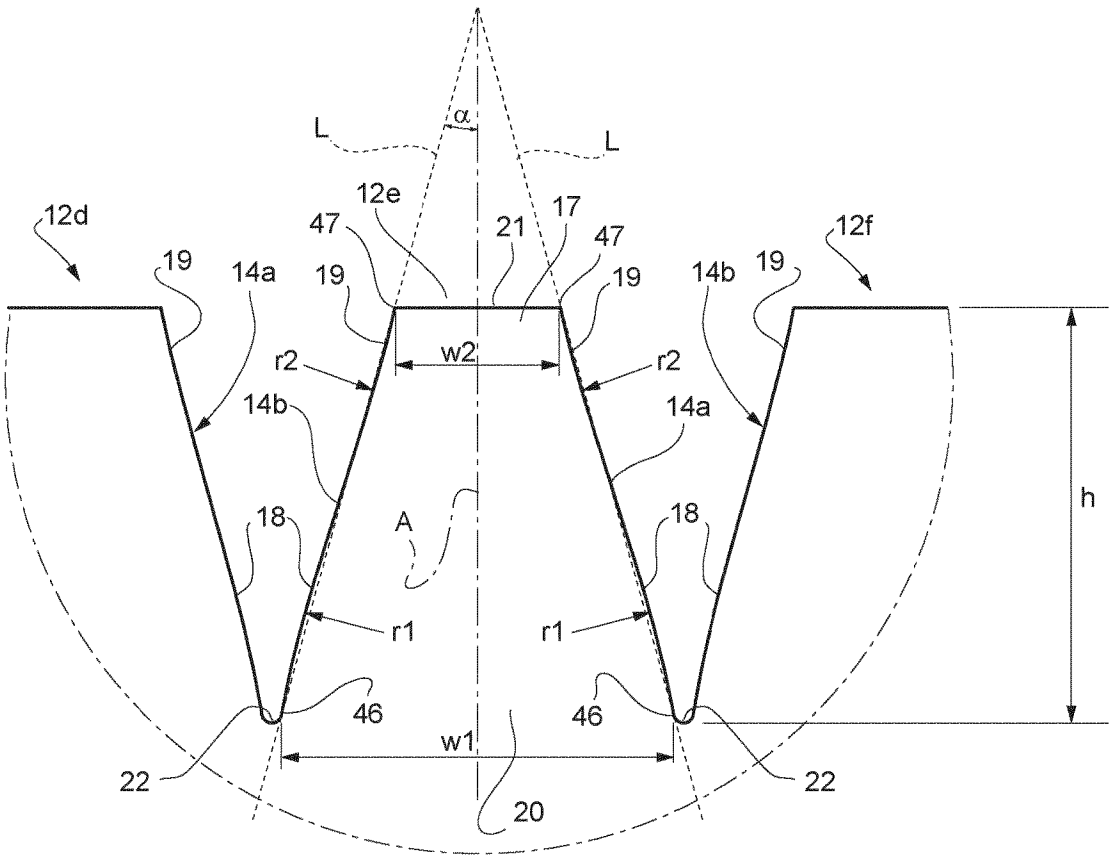
Figure 4:
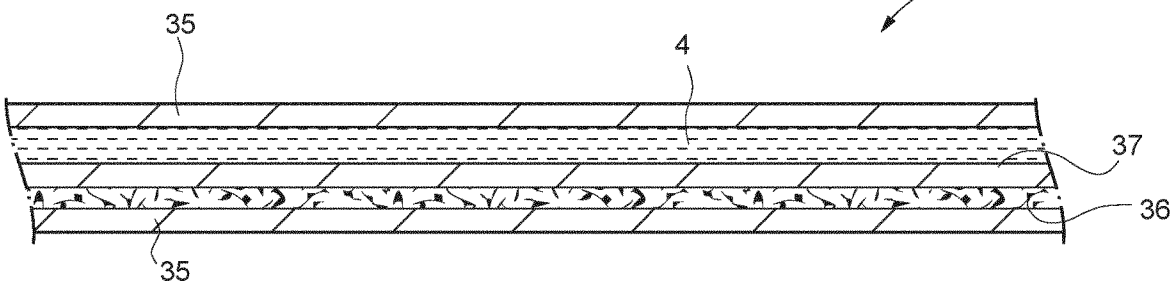
FIG. 4 is a cross-sectional side view of the multilayer packaging material.

In FIGS. 3*a* and 3*b*, one notes that sidewall 7 or prior to folding and sealing of blank 30 the main portion 31 comprises a plurality of curved connection portions 22, each one interposed between and connecting two neighboring flap sections 12*a* to 12*h*. In particular, each curved connection portion 22 extends between two respective first locations 46. Preferentially, a distance between the respective first locations 46 is at least 0.6 mm, in particular at least 0.8 mm.

The flap sections 12*a* to 12*h* of the specific example of FIGS. 1 to 3*b* may be such that all the flap sections 12*a* to 12*h* may have the same shape and the same dimension. One also notes when reverting to FIG. 3*a* that the flap section 12*a* may comprise two portions 50*a* and 50*b* being arranged at opposed sides of the blank 30. Furthermore, at least one of the portions 50*a* and 50*b* may have a size which is larger than half of the size of the flap section 12*a*. This is as during the folding of the blank 30, the portions 50*a* and 50*b* overlap with one another and, accordingly, the size and the shape of the portion 50*a* and/or the portion 50*b* must be chosen so as to compensate for the overlap.

Figure 8A:
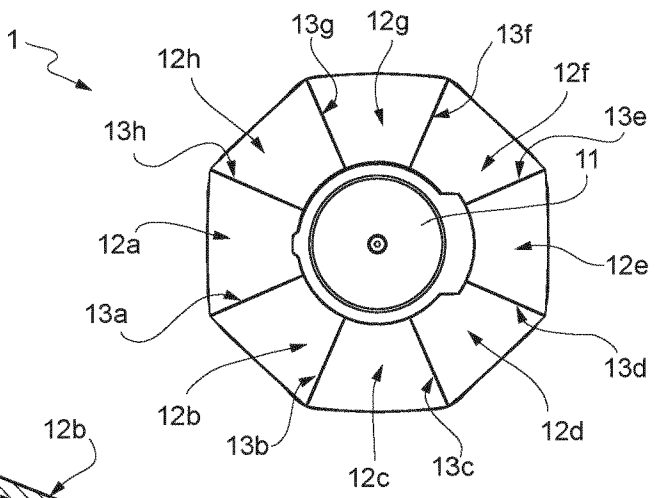
Figure 8B:
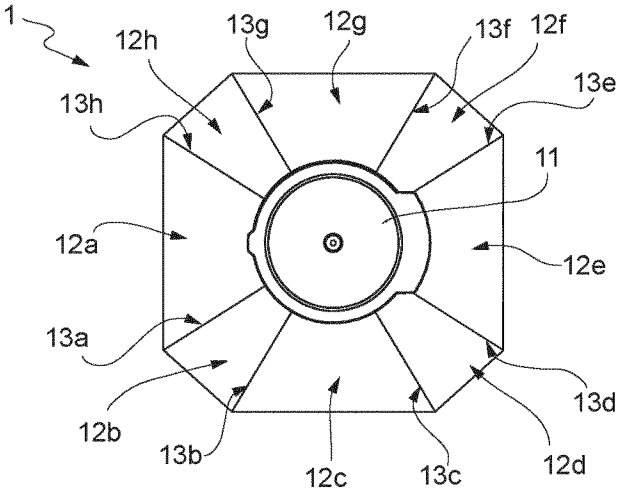
Figure 8C:
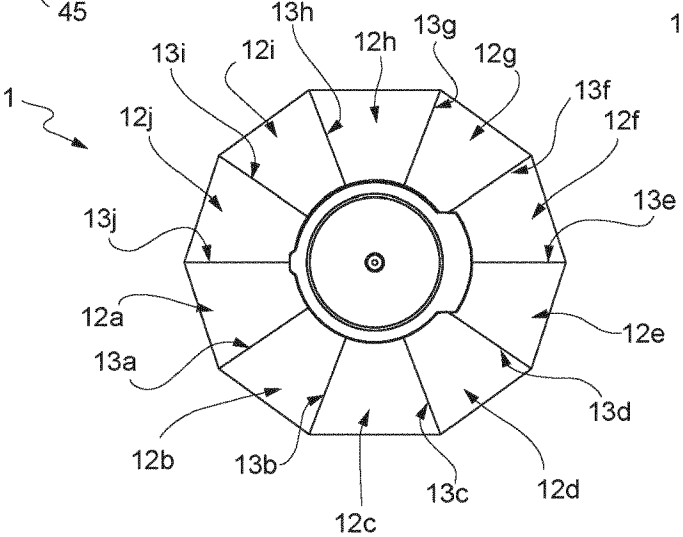
Figure 8D:
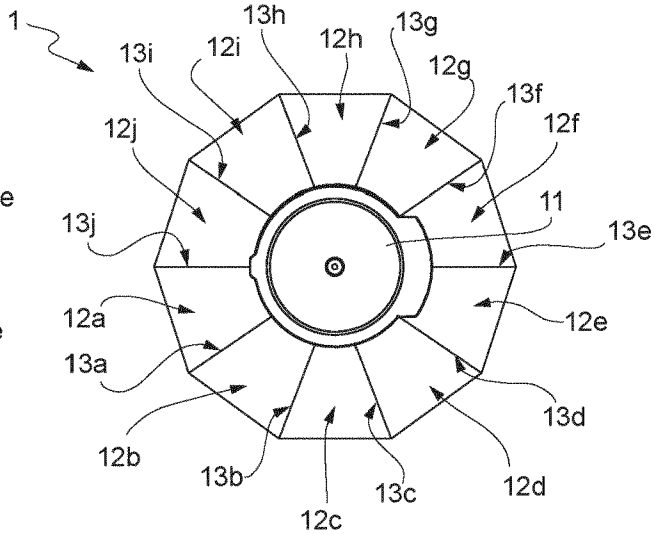

FIGS. 8*b* to 8*d* show top views of variations of package 1 with respect to the one of FIGS. 1 to 2*b*. In order to facilitate the comparison between the variations of the package 1, the top view of the package 1 of FIGS. 1 to 2*b* is newly reproduced in FIG. 8*a*.

From the comparison of FIGS. 8*a* to 8*d*, one notes that in dependence of the specific choice of the shape and size and/or the number of the flap sections, it is possible to vary the specific shape of the respective shoulders 8. Furthermore, it may be possible that the flap sections of a package 1 may not have the same size and shape (see e.g. FIG. 8*b* or FIG. 8*d*).

E.g. FIG. 8*b* shows a package 1 having the flap sections 12*a* to 12*h* and FIG. 8*d* shows a package 1 having the flap sections 12*a* to 12*j*.

One identifies that a package 1 may have a first group of flap sections 12*a*, 12*c*, 12*e*, 12*g* (, 12*i*) and a second group of flap sections 12*b*, 12*d*, 12*f*, 12*h* (, 12*j*). Thereby, the flap sections 12*a*, 12*c*, 12*e*, 12*g* (, 12*i*) of the first group and the flap sections 12*b*, 12*d*, 12*f*, 12*h* (, 12*j*) of the second group may be alternatingly arranged. This means that each flap section 12*a*, 12*c*, 12*e*, 12*g* (, 12*i*) of the first group has two neighboring flap sections 12*b*, 12*d*, 12*f*, 12*h* (, 12*j*) of the second group and vice versa.

E.g. in the example of FIG. 8*b*, the first group comprises the flap sections 12*a*, 12*c*, 12*e* and 12*g* and the second group comprises the flap sections 12*b*, 12*d*, 12*f* and 12*h*. In the example of FIG. 8*d*, the first group also comprises the flap section 12*i* and the second group also comprises the flap section 12*j*.

When comparing FIGS. 8*a* and 8*c* one notes that the number of the flap sections differ, but the respective flap sections have the same size and shape.

A further example of a package 1 is shown in FIG. 9 in perspective view. FIG. 10 illustrates thereby the respective blank 30 which forms the basis of the respective side wall 7, the respective base 6 and the flaps sections 12*a* to 12*h*.

One notes that similar to the examples of FIGS. 8*b* and 8*d*, there are two groups of flap sections. While the flap sections 12*a*, 12*c*, 12*e* and 12*g* of the first group have the same shape and size, also the flap sections 12*b*, 12*d*, 12*f* e 12*h* of the second group have the same shape and size when being compared with respect to one another. However, the shape and size of the flap sections 12*a*, 12*c*, 12*e* and 12*g* of the first group and of the flap sections 12*b*, 12*d*, 12*f* e 12*h* of the second group differ with respect to one another.

As mentioned above, the neck 9 and the seams 13*a* to 13*h* are obtained during a molding process, in particular during a single molding step. FIG. 5 shows portions of a mold 24 configured to allow for the molding of neck 9 and seams 13*a* to 13*h* to flap sections 12*a* to 12*h*. The specific example of FIG. 5 shows a mold 24 configured to mold the neck 9 and the seams 13*a* to 13*h* of the package 1 of FIGS. 1 to 2*b*. However, from the following description it will become clear on how to modify the mold 24 so as to also mold the respective necks 9 and the respective seams 13*a* to 13*h* of the variations of the packages 1 as shown in FIGS. 8*b* to 8*d* and 9.

The mold 24 has an inner mold tool 25 and an outer mold tool 28 (the outer mold tool 28 being only partially shown in FIG. 5) defining together a mold cavity 29 configured to allow for the formation of the neck 9.

The inner mold tool 25 comprises:

a plurality of engagement sections 26*a* to 26*h* configured to receive and fold the flap sections 12*a* to 12*h* in collaboration with the outer mold tool 28 towards each other such that the lateral edges 14*a* and 14*b* of the flap sections 12*a* to 12*h* face the lateral edges 14*b* and 14*a* of the neighboring flap sections 12*a* to 12*h*, and mold channels 27*a* to 27*h*, each located between two respective engagement sections 26*a* to 26*h* and configured to allow for the formation of the molded seams 13*a* to 13*h*.

The mold 24 may also comprise one or more distribution channels 51 configured to distribute the molten polymer into the mold cavity 29 and the mold channels 27*a* to 27*h*. The outer mold tool 28 may comprise at least some of the distribution channels 51.

The engagement sections 26*a* to 26*h* may be complementary in size and shape to the size and shape of the flap sections 12*a* to 12*h*. E.g. the size and shape of the respective inner mold tools 25 adapted to form the respective necks 9 and the respective seams 13*a* to 13*h* of the packages 1 of FIGS. 8*b* to 8*d* and 9, must be adopted to the specific shapes and sizes and the numbers of the flap sections.

Moreover, the engagement sections 26*a* to 26*h* and the mold channels 27*a* to 27*h* may be formed such to guarantee the formation of the first lateral portions 43 and the second lateral portion 44 and such that these are connected and/or fused and/or molded onto the respective flap sections 12 to 12*h*.

The outer mold tool 28 may comprise a first portion 52 and a second portion (symmetric to the first portion 52 and not shown). The first portion 52 and the second portion of the outer mold tool 28 may be distinct and, in use, are approached to one another so as to delimit in collaboration with the inner mold tool 27 the mold cavity 29.

The inner mold tool 27 and the outer mold tool 28 may be configured such that the flap sections 12*a* to 12*h* are, in use and during the execution of the mold process, clamped between an outer surface 53 of the inner mold tool 27 and an inner surface 54 of the outer mold tool 28.

Furthermore, the outer surface 53 and the inner surface 54 may be complementary to one another and may define in collaboration the shape of the shoulder 8.

Each one of the mold channels 27*a* to 27*h* and the flap sections 12*a* to 12*h* may comprise portions of the outer surface 53.

Furthermore, mold channels 27 may be formed such that the thickness d1 is larger than the thickness d2. Moreover, the mold channels 27 may also be formed such that also the thickness d3 may be larger than the thickness d2.

FIGS. 6*a* to 6*f* show in enlarged view a plurality of varying types of mold channels 27*a* to 27*h*, which may be provided on the inner mold tool 27. The specific choice of the type of mold channel 27*a* to 27*h* may depend on the size and/or shape of the flap sections 12*a* to 12*h*, the number of the flap sections 12*a* to 12*h*, on the type of polymer used and others.

It should be noted that the number and the respective sizes and shapes of the engagement sections 26*a* to 26*h* depend on the specific number, sizes and shapes of the flap sections 12*a* to 12*h* or 12*a* to 12*j*.

FIG. 11 shows a flow diagram of a method for packaging the food product into package 1, in particular as it is operated within an automatic packaging machine. The method comprises the steps of:

a) providing the blank 30 having the respective main portion 31 and the flap sections 12*a* to 12*h* extending from the main portion 31, b) folding and longitudinally sealing the blank 30 so as to form the sidewall (7), c) folding the flap sections 12*a* to 12*h* towards each other so that the lateral edges 14*a* and 14*b* of neighboring flap sections 12*a* to 12*h* face each other, d) injection molding the neck (9) and the molded seam portions 13*a* to 13*h* to join the lateral edges 14*a* and 14*b* of the neighboring flap sections 12*a* to 12*h* so as to form the shoulder (8), e) filling the food product into the partially formed package 1 at an open bottom end of the package 1, in particular the main body 2, and f) sealing the bottom end to form the base 6.

The method may also comprise the step of g) providing and/or applying the closure 11 on the neck 9. This step may be performed before filling the food product into the package 1. Alternatively, this step may be performed after filling the food product into the package 1, typically when the neck 9 includes a membrane that seals the neck 9.

In particular, the steps a) to f) may be executed in sequence of their appearance.

The method may also comprise a plurality of further steps h) of repetition, during which the steps a) to f) or a) to g) are repeated.

In more detail, during the step a) the sub-steps of:

a1) providing the web of the multilayer packaging material, and a2) cutting the web of the multilayer packaging material, in particular in correspondence with the respective repeat unit, for forming the blank 30.

During the step b) the blank 30 may b e formed such to form a tubular package having the bottom open end and a top open end opposite to the bottom open end. In particular, the flap sections 12*a* to 12*h* may define the top open end.

During the step c) the inner mold tool 27 and the outer mold tool 28 may be approached towards one another such that the flap sections 12*a* to 12*h* engage onto engagement sections 27*a* to 27*h*. Furthermore, during the step c) the flap sections 12*a* to 12*h* are clamped between the outer surface 53 and the inner surface 54.

During the step d), the molten polymer may be injected, in particular through the distribution channels 51, into the mold cavity 29 for forming the neck 9 and into the mold channels 27*a* to 27*h* for forming the seams 13*a* to 13*h*.

After the molding of the neck 9 and the seams 13*a* to 13*h*, the inner mold tool 27 and the outer mold tool 28 may be separated from one another.

Furthermore, after the molding the packaging 1 is partially formed with the bottom open end being still open so that the food product can be introduced into the partially formed package 1 through the bottom open end.

The step g) may be executed prior to the step e) and the step f). Alternatively, in case that the neck 9 may comprise a rupturable membrane covering the pouring outlet 10, the step g) may also be executed after the step e) and/or the step f).

From the description above follows that, although various embodiments of the invention have been described and shown, the invention is not restricted thereto, but may also be embodied in other ways within the scope of the subject-matter defined in the following claims.

The invention claimed is:

1. A package for holding a food product, the package comprising a base, a sidewall, a shoulder, a neck and a closure for forming a sealed, inner space for the food product, the base and the sidewall being formed from a multilayer packaging material that comprises a layer of fibrous material, wherein the shoulder comprises a plurality of flap sections that are formed from a multilayer packaging material, extend from the sidewall and are folded towards each other in a direction towards the neck, with each flap section having lateral edges facing lateral edges of neighboring flap sections, and a plurality of molded seams that join the lateral edges of neighboring flap sections, wherein each lateral edge comprises a first curved portion and a second curved portion, wherein the first curved portion is different from the second curved portion, and/or the first curved portion is convexly shaped and the second curved portion is concavely shaped with respect to a central axis of the respective flap section.

2. The package according to claim 1, wherein the neck is a molded neck that is joined with the molded seams, the molded seams extending from the molded neck, along the lateral edges of the flap sections and in a direction towards the sidewall.

3. The package according to claim 1, wherein each flap section comprises a top edge, the neck being molded to each of the top edges of the flap sections.

4. The package according to claim 1, wherein the molded seams are integrally molded with the molded neck.

5. The package according to claim 1, wherein the flap sections are integrally formed with the sidewall.

6. The package according to claim 1, wherein the molded seams are overmolded on the lateral edges of the flap sections.

7. The package according to claim 1, wherein the combined thickness of each molded seam and the respective flap sections that are joined by the molded seam is at least 20% greater than a thickness of the molded seam at a location between the lateral edges of the flap sections that are joined by the molded seam.

8. The package according to claim 1, wherein each lateral edge comprises a curved shape.

9. The package according to claim 1, wherein each flap section comprises a base portion integrally joined with the sidewall, and a top portion having a top edge opposite to the base portion, and the lateral edges of each flap section are spaced apart from one another and joined with the base portion and the top portion of the respective flap section.

10. The package according to claim 9, wherein the width of the base portion is larger than the width of the top portion.

11. The package according to claim 1, wherein the flap sections comprise a first group of flap sections and a second group of flap sections; wherein the flap sections of the first group of flap sections have different shapes and dimensions than the flap sections of the second group of flap sections.

12. A mold for molding a neck and molded seams of a package according to claim 1, the mold having an inner mold tool and an outer mold tool, defining in collaboration a mold cavity configured to allow for the formation of the neck, wherein the inner mold tool comprises engagement sections configured to receive and fold flap sections in collaboration with the outer mold tool towards each other such that lateral edges of the flap sections face lateral edges of neighboring flap sections, and wherein mold channels are located between the engagement sections and configured to allow for the formation of the molded seams.

13. A method for packaging a food product into a package according to claim 1, the method comprising:

providing (a)) a blank of a multilayer packaging material having a main portion and a plurality of flap sections that extend from the main portion, folding and longitudinally sealing (b)) the blank so as to form the sidewall, folding (c)) the flap sections towards each other so that lateral edges of neighboring flap sections face each other, injection moulding (d)) the neck and the molded seam portions to join the lateral edges of neighboring flap sections so as to form the shoulder, filling (e)) a food product into the package at a bottom end of the package, and sealing (f)) the bottom end to form the base.

* * * * *